United States Patent [19]

Gater

[11] 4,372,594

[45] Feb. 8, 1983

[54] BAYONET JOINT BACKSET ADJUSTMENT FOR LATCH CONSTRUCTIONS

[75] Inventor: Arnold C. Gater, Anaheim, Calif.

[73] Assignee: Emhart Industries, Inc., Farmington, Conn.

[21] Appl. No.: 188,758

[22] Filed: Sep. 19, 1980

[51] Int. Cl.[3] ..... E05C 1/16

[52] U.S. Cl. ..... 292/337; 292/DIG. 44; 292/DIG. 60

[58] Field of Search ..... 292/1, 169, 337, DIG. 44, 292/DIG. 60

[56] References Cited

U.S. PATENT DOCUMENTS

| | | | |
|---|---|---|---|
| 294,560 | 3/1884 | Woodrich et al. . | |
| 365,152 | 6/1887 | Simson . | |
| 1,661,454 | 3/1928 | Wilson . | |
| 1,672,076 | 6/1928 | Munson . | |
| 2,586,066 | 2/1952 | Larson | 292/337 X |
| 2,937,897 | 5/1960 | Soderberg | 292/1 |

*Primary Examiner*—Richard E. Moore

*Attorney, Agent, or Firm*—Mahoney & Schick

[57] ABSTRACT

A bolt is conventionally reciprocal in a stationary casing with each being formed of longitudinally telescoped parts and with the parts of each being bayonet joint connected. Each bayonet joint connection is comprised of a projection of one part selectively movable in a pair of longitudinally spaced, transverse slots separated by a longitudinal slot in the other part, whereby each may be selectively longitudinally adjusted the same determined amount for increasing or decreasing the backset distance between the forward extremities of the casing and the latch operator transverse axis the same determined amount. The transverse cross sections of certain slidably reciprocal mating parts of the bolt and casing are formed generally mutually rectangular so that rotational movements of one during the backset adjustment will positively require the same rotational movements of the other. A spring-pressed friction member between the casing telescoped parts frictionally resists movement therebetween minimizing any danger of non-planned, accidental backset adjustment.

9 Claims, 9 Drawing Figures

BAYONET JOINT BACKSET ADJUSTMENT FOR LATCH CONSTRUCTIONS

BACKGROUND OF THE INVENTION

This invention relates to a unique backset adjustment for latch constructions of the type normally used in doors and the like. More particularly, this invention relates to a preferred bayonet joint backset adjustment which is installed in each of the casing and bolt of such latch construction and is conveniently operable with far greater ease than has heretofore been possible. Thus, with minimum preplanned manipulation, it is possible to increase or decrease the backset distance of the stationary casing and to conform the movable bolt to such backset change, thereby adapting the overall latch construction to various backset measurements.

With latch constructions of the type for use with doors and the like, the backset measurement thereof is that distance between the forward extremities of the stationary casing longitudinally rearwardly to the transverse axis about which the latch operator moves for extending and retracting the bolt of the latch construction. Such measurement or measurements have, for the most part, been standardized by the industry. With such standardization, it is known when a latch construction is purchased that in a usual installation, the backset measurement will be a standard amount and from a practical standpoint, his measurement will be calculated from the forward exposed surface of the latch mounting face plate which, in effect, is the forward extremity of the stationary frame or casing. Again in a usual installation, the face place is recessed in the door edge with the front surface of the face plate aligned with the door edge so that in most cases, the backset measurement is also the distance from the door edge to the axis of the latch operator.

In the past years, the most prevalent backset has been standardized at two and three eighths inches so that it has normally been known prior to latch construction installation what the backset measurement would be, thereby permitting standardized original installation and a high degree of interchangeability between various latch constructions. It is true that there have been a few "special" latch constructions having "special" backset measurements, but these have always been considered different and of no overall consequence, except requiring individual considerations for proper installation. However, more recently a greater and greater percentage of latch constructions are being produced with a greater backset measurement for various reasons, including the provision of greater longitudinal length for greater bolt throw, that is, the longitudinal distance that the bolt is moved between retracted and extended position, in order to, in turn, provide increased security.

Therefore, an increased second backset measurement standard has been now adopted by the industry, such second standard being two and three quarters inches, three eighths inches greater than the previous first standard backset. Most manufacturers of latch constructions have satisfied this demand for the alternate two backset measurements by producing and marketing two different and distinct models of many of the latch constructions. One model has a backset measurement of two and three eighths inches to satisfy the demand for the old standard backset, while the other model has the new standard backset of two and three quarters inches, all of which is relatively costly in view of the need for manufacturing multiple models.

Thus, there is a distinct want and need in the industry for single models of latch constructions which are relatively quickly and easily selectively adjustable between the two standard backset measurements, that is, between two and three eighths inches and two and three quarters inches. Furthermore, such adjustability must be of a relatively simple nature for preforming the adjustment manipulation. Latch construction installation is frequently performed by expert workman well versed in the latch construction field and to them, adjustment simplicity may not be of maximum consequence, but latch construction installation is also performed in an equal, if not greater, number of instances by ordinary homeowners that are not trained in the latch construction field and for them, adjustment simplicity is of maximum importance.

OBJECTS AND SUMMARY OF THE INVENTION

It is, therefore, an object of this invention to provide a latch construction of the type for doors and the like having at least two, easily adjustable, backset distance settings provided therein, the backset distance setting adjustability being easily utilized by inexperienced installation personnel and without a full technical understanding of latch constructions in general. The backset distance adjustment is quickly and easily performed and is arranged to minimize any possibility of adjustment error. Furthermore, the provision of this dual backset adjustment in single models of latch constructions eliminates the necessity of providing completely distinct and separate latch construction models for satisfying the two backset standards.

It is a further object of this invention to provide a latch construction of the foregoing general nature and having the distinct backset adjustment features therein, yet the same, due to the unique simplified form thereof, may be manufactured and marketed at a minimum of additional cost. In the preferred embodiment form of the latch construction of the present invention, the latch constructions may be formed virtually identical to the prior latch constructions having only the single backset measurement provision with the exception only of forward casing and bolt formation. In other words, the entire basic bolt operating mechanism including the operator assembly, the basic latch construction frame, the movable bolt operator or operators and the movable bolt connected operating levers may remain identically the same.

The basic change for providing the backset adjustability principles of the present invention involves primarily the forward stationary casing and the bolt longitudinally forwardly and rearwardly reciprocal therein. Preferably, each is formed of two telescoped parts, the parts of each being operably connected by a projection and slots broadly comprising a bayonet joint. Each such projection and slot arrangement is formed longitudinally adjustable preferably the same determined amount. Thus, the casing may be selectively adjusted longitudinally forwardly and rearwardly for increasing and decreasing the backset distance and the bolt may be similarly adjusted for conforming thereto.

It is still a further object of this invention to provide a backset adjustable latch construction of the foregoing general nature which preferably has specifically incorporated therein, certain adjustment means so formed as to minimize possibilities of adjustment error during the backset adjustment functioning. With the foregoing preferred bayonet joint selective adjustment for each of the casing and bolt, each is formed for movement of parts thereof during the backset adjustment setting first transversely partially rotatable from one backset adjustment, then longitudinally movable and finally again transversely partially rotatable to the new backset adjustment. By preferably forming those certain movable parts of each of the casing and bolt having common preferably rectangular cross sectional shapes, it is positively required that when the casing parts are transversely partially rotated, the mating bolt parts are transversely partially rotated. With this common required movement, simultaneous equal adjustments are more completely assured.

Other objects and advantages of the invention will be apparent from the following specification and the accompanying drawings which are for the purpose of illustration only.

DESCRIPTION OF THE BEST EMBODIMENT CONTEMPLATED

Figure 1:
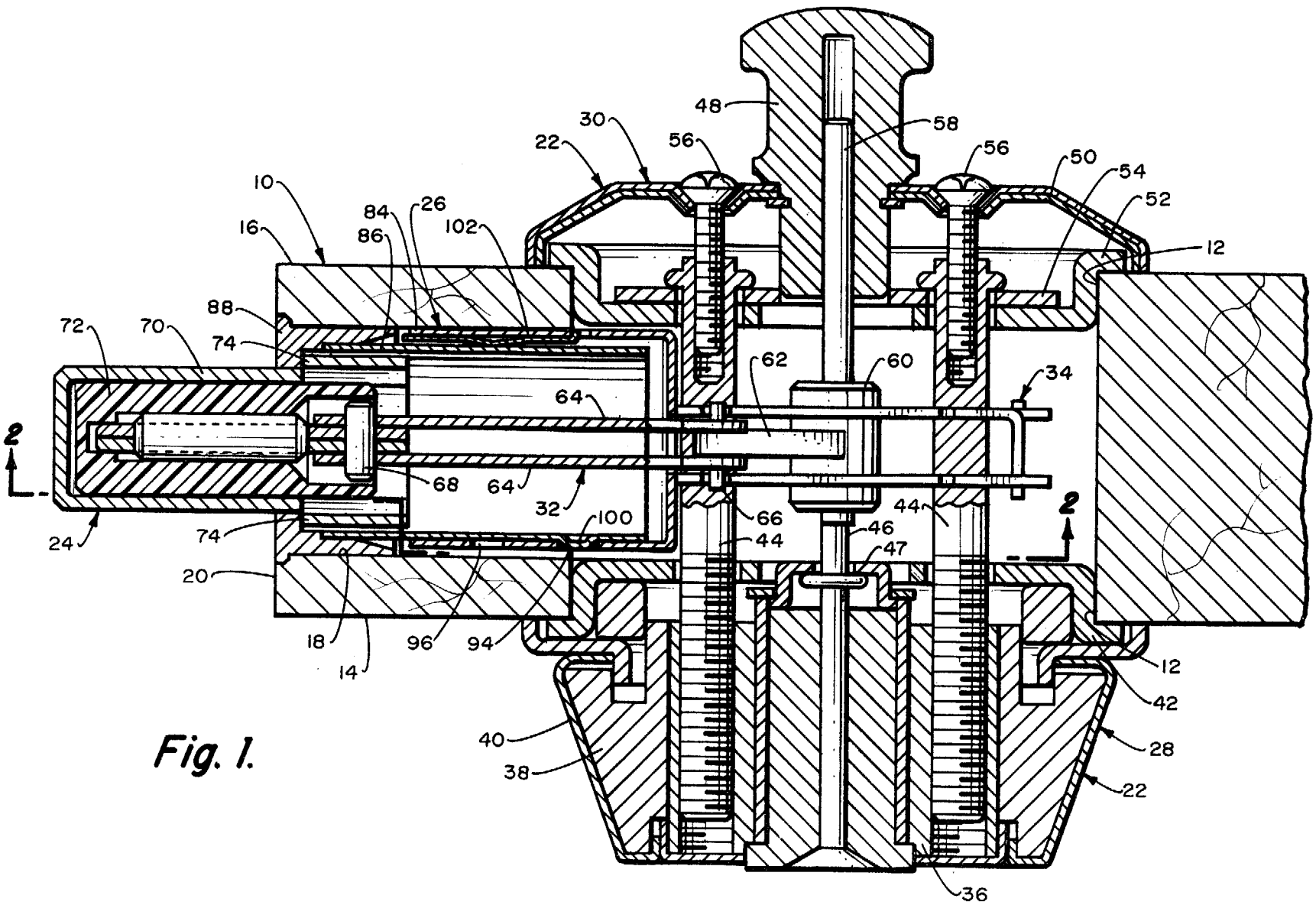
FIG. 1 is a horizontal sectional plan view of a typical latch construction mounted in a door and incorporating a preferred embodiment of the backset adjustment principles of the present invention, the latch construction being shown in bolt extended position and the backset adjustment being shown in first or minimum backset adjustment.

Referring to the drawings and, for the moment, particularly FIG. 1 thereof, the backset adjustment improvements of the present invention are shown installed in an otherwise typical latch construction, in this instance, a typical deadbolt construction. It is initially pointed out that the latch or deadbolt construction may be fabricated by usual manufacturing methods and using usual materials, all well known to those skilled in the art. Furthermore, although the improvements of the present invention are illustrated herein in a particular environment, it should be understood that it is not intended to limit the principles of the present invention to the particular environmental latch construction shown, but rather, the principles of the present invention should be broadly construed within the limitations expressed in the appended claims.

More particularly to FIG. 1, the latch construction in the form of the deadbolt construction is illustrated installed in a typical door generally indicated at 10 having a transverse latch opening 12 formed therethrough between an outer door face 14 and an inner door face 16, the transverse latch opening 12, in turn, transversely intersecting a longitudinal latch opening 18 terminating longitudinally forwardly through a vertical door edge 20. Generally, the deadbolt construction includes latch operating means generally indicated at 22 extending partially transversely and partially longitudinally within the door openings 12 and 18 operably connected for reciprocally moving a bolt assembly generally indicated at 24 between extended and retracted positions within a bolt casing assembly generally indicated at 26 and relative to the door edge 20. The latch operating means 22 is comprised of an outside operator assembly generally indicated at 28 and an inside operator assembly generally indicated at 30 operably connected to a latch driving mechanism generally indicated at 32 movable within a stationary frame generally indicated at 34.

Specifically, the outside operator assembly 28 is formed with a typical lock cylinder 36 primarily outwardly of the outer door face 14 radially telescoped by a hardened guard collar and ring assembly 38, and finally by a cover assembly 40. The lock cylinder 36, guard collar and ring assembly 38, and cover assembly 40 are secured transversely inwardly against and within a reinforcing plate 42 primarily within the transverse latch opening 12 by a pair of primary fasteners 44. The outside operator assembly 28 is completed by a primary spindle 46 extending transversely into the transverse latch opening 12 intersecting the longitudinal latch opening 18, being secured rotatable with a lock plug 47 of the lock cylinder 36.

The insider operator assembly 30 is formed by a hand operating knob 48 rotatable within a cover assembly 50 which, in turn, encompasses a similar reinforcing plate 52 extending transversely inwardly primarily within the transverse latch opening 12. A backing plate 54 is secured outwardly abutting the reinforcing plate 52 by the heads of the primary fasteners 44, and a pair of secondary fasteners 56 are engaged with the cover assembly 50 and are secured to the outer ends of the primary fasteners 44. The inside operator assembly 30 is completed by a transversely extending secondary spindle 58 outwardly secured rotatable with the hand operating knob 48 and projecting inwardly through the transverse latch opening 12 likewise transversely intersecting the longitudinal latch opening 18.

The latch driving mechanism 32 within the longitudinal latch opening 18 is formed rearwardly by a crank hub 60 transversely rotatable in the stationary frame 34 and having an integral, slotted crank arm 62 projecting radially therefrom. The inner ends of the primary and secondary spindles 46 and 58 are preferably telescoped and extend transversely through the crank hub 60 nonrotatably engaged therewith. A pair of longitudinally reciprocal driving levers 64 are rearwardly pivotally connected to the free end of the crank arm 62 by a transverse pin 66 through the slot of the crank arm and are forwardly pivotally connected to a rearward extension of the bolt assembly 24 by a transverse pin 68.

Thus, in general and not considering the improvements of the present invention, partial rotation of either of the primary or secondary spindles 46 or 58 by their connected lock cylinder or hand operating knob 36 or 48 will rotate the crank hub 60 and crank arm 62 to longitudinally reciprocate the driving levers 64, thereby longitudinally reciprocating the bolt assembly 24 between extended position shown, for instance, in FIG. 1, and retracted position. As is usual, in the retracted position of the bolt assembly 24, such assembly is substantially fully withdrawn within the casing assembly 26, the forward extremity of the bolt assembly usually being substantially even with the door edge 20. Furthermore, it will be noted for the purpose of the later to be described improvements of the present invention that the transverse axis of the latch operator is the transverse axis of either of the primary or secondary spindles 46 or 58, such spindles constituting the latch operator or operators.

Figure 2:
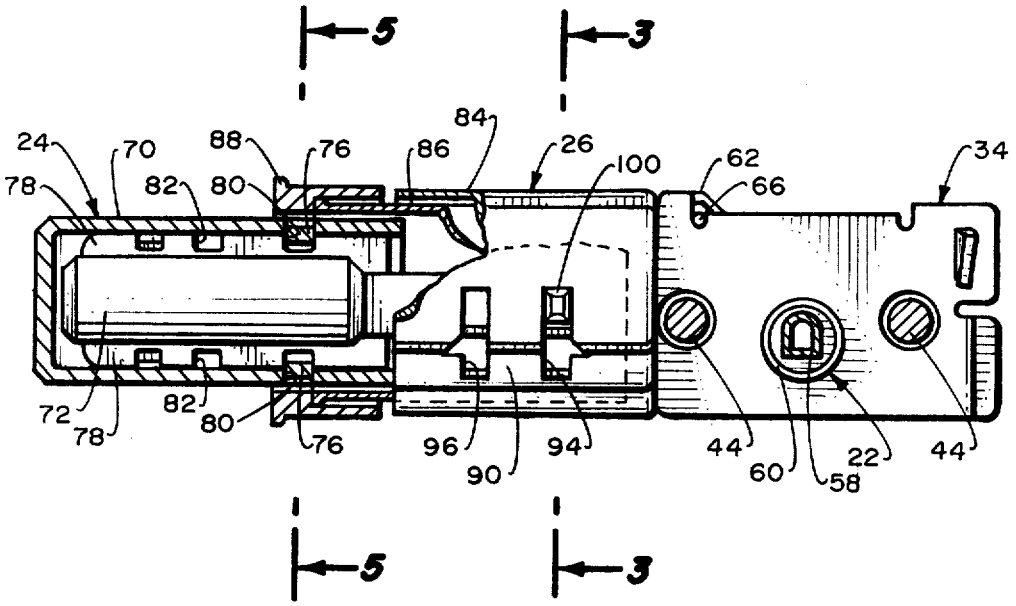
FIG. 2 is a reduced, longitudinal, vertical sectional view with parts broken away to more clearly show interior parts and looking in the direction of the arrows 2—2 in FIG. 1.
Figure 3:
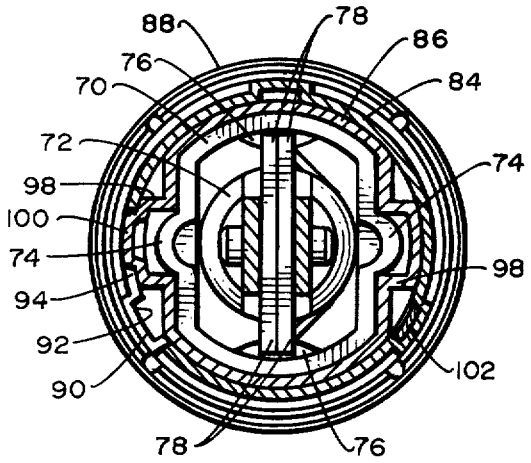
FIG. 3 is an enlarged, transverse, vertical sectional view looking in the direction of the arrows 3—3 in FIG. 2, the section being taken through a portion of the casing backset adjustment and showing the bolt backset adjustment in the background.
Figure 9:
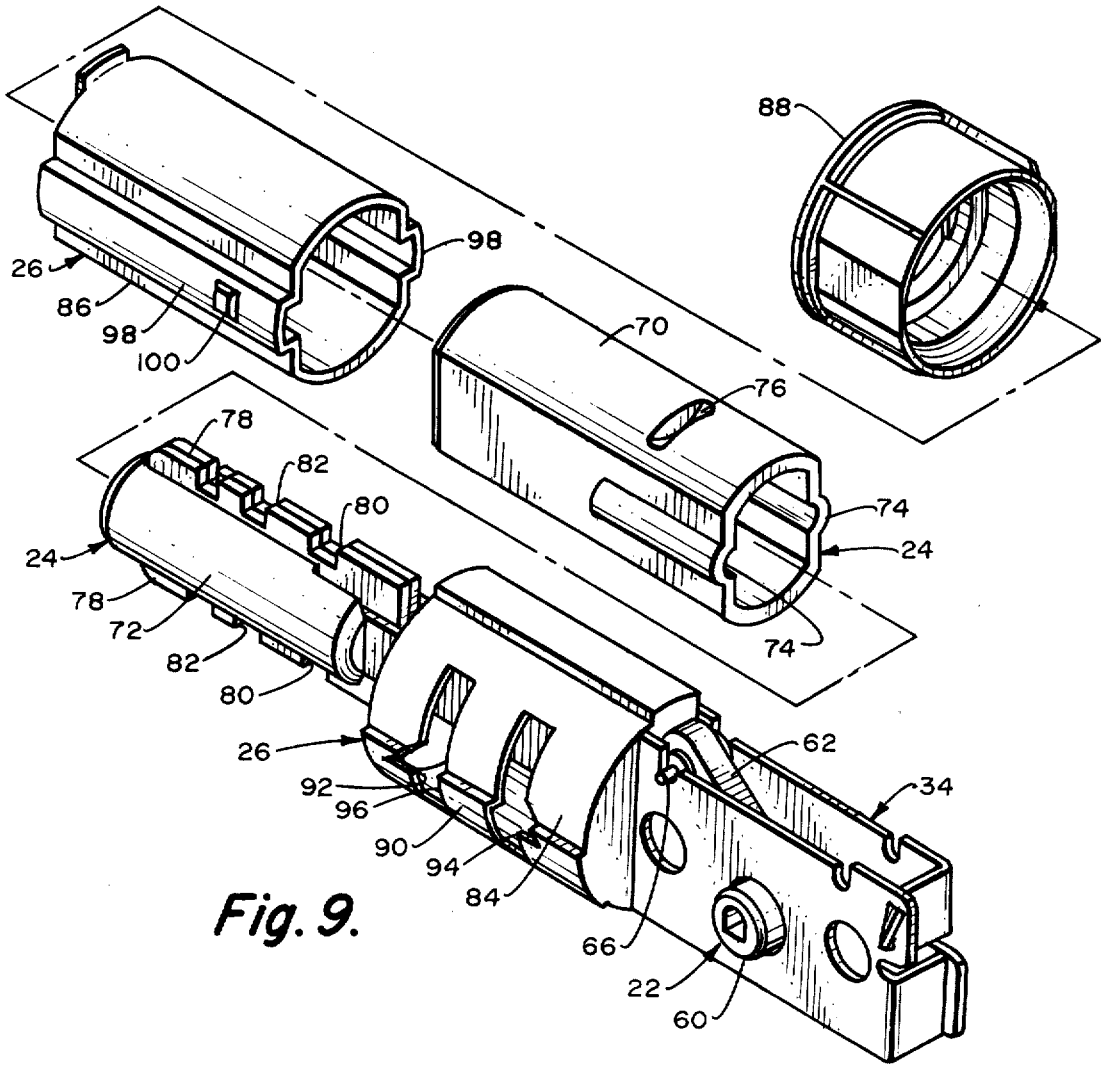
FIG. 9 is an exploded view illustrating the various parts of the latch construction including the backset adjustment of the present invention.

More particularly to the improvements of the present invention, and referring for the moment particularly to FIGS. 1, 2 and 9, the bolt assembly 24 includes an outer bolt 70 somewhat in the form of a longitudinally rearwardly opening cap and an inner bolt carriage 72 formed of an outer thickened shell connected by its rearward extension to the driving levers 64 of the driving mechanism 32 as hereinbefore described and preferably encompassing a usual hardened security core as shown in FIG. 1. The outer bolt 70 is shaped in transverse cross section generally rectangular with flat vertical sides and slightly radiused upper and lower sides, transversely opposite guide tabs 74 projecting transversely from the flat vertical sides and inwardly extending projections 76 being vertically formed in the radiused upper and lower sides as particularly clearly seen in FIG. 9. The inner bolt carriage 72 in primary outer contour is generally cylindrical of a size predicated to telescope within the outer bolt 70, but vertically upwardly and downwardly extending positioning ridges 78 are formed thereon each having at least two identical, longitudinally spaced, backset transverse positioning slots therethrough, the rearward being rear backset positioning slots 80 and the forward being forward backset positioning slots 82 as again clearly seen in FIG. 9. In effect, the rear and forward backset positioning slots 80 and 82 comprise transverse slots which are longitudinally connected at either side of the positioning ridges 78 by a longitudinal slot formed by the outer cylindrical surface of the inner bolt carriage 72 of a diameter less than the outer extremities of the positioning ridges 78.

Figure 8:
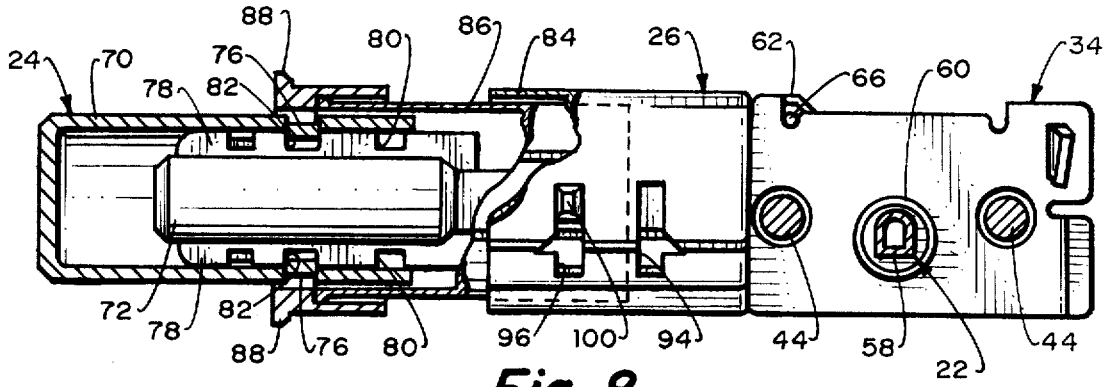
FIG. 8 is a view similar to FIG. 7, but with the certain parts of the casing and bolt finally transversely partially rotated to place the latch construction fully in second or maximum backset adjustment.

Thus, the outer bolt 70 may be brought into telescoped assembly with the inner bolt carriage 72 by rotating the inner bolt carriage so that the positioning ridges 78 thereof are longitudinally misaligned with or transversely adjacent the projections 76 of the outer bolt 70, thereby permitting free longitudinal movement therebetween. When the inner bolt carriage 72 is brought forward a maximum longitudinal distance relative to the outer bolt 70 and then rotated to engage the outer bolt projections 76 transversely into the rear backset positioning slots 80 of the inner bolt carriage 72 to the position shown in FIGS. 1 and 2, the bolt assembly 24 is of minimum longitudinal length and as will be hereinafter more clearly seen, this will comprise bolt minimum backset position. By partially rotating the inner bolt carriage 72 relative to the outer bolt 70 removing the outer bolt projections 76 from the rear backset positioning slots 80 of the inner bolt carriage 72, the inner bolt carriage 72 may be moved longitudinally rearwardly relative to the outer bolt 70 aligning the projections 76 transversely with the forward backset positioning slots 82 and the reverse partial rotation will bring the projections 76 transversely into engagement with the forward backset positioning slots 82, thereby positioning the bolt assembly 24 in an increased longitudinal length form as shown in FIG. 8 which will comprise the bolt maximum backset position. Furthermore, it is seen that this bolt length adjustability of bolt backset position adjustability is accomplished by a bayonet joint arrangement or connection between the outer bolt 70 and the inner bolt carriage 72 selectively operable for producing such adjustability.

The casing assembly 26 is likewise formed by longitudinally telescoped parts, a first or outer casing part 84 rearwardly secured to the latch stationary frame 34 and forwardly telescoping an inner casing part 86 forwardly secured to a partially telescoping circular face plate assembly 88. Again referring to FIG. 9 for the moment, the outer casing part 84 is formed radially outwardly with a longitudinal, generally U-shaped ridge 90 thereby, in turn, forming an inwardly opening, longitudinal positioning slot 92. The longitudinal positioning slot 92 is transversely intersected by a transverse rear backset positioning slot 94 and a transverse forward backset positioning slot 96. The inner casing part 86 is formed hollow, generally rectangular in cross section so as to conform to and receive the bolt assembly 24 reciprocal therein and the bolt assembly outer bolt 70 transversely nonrotatable therein. Opposite, longitudinal, generally U-shaped ridges 98 are formed outwardly on the inner casing part for receiving and guiding the outer bolt guide tabs 74 with the ridge 98 adjacent the previously described positioning slots 92, 94 and 96 of the outer casing part 84 being formed with an outward projection 100 dimensioned for reception and movement in the positioning slots of the outer casing part 84.

Thus, with the projection 100 of the inner casing part 86 longitudinally aligned with and movable longitudinally within the longitudinal positioning slot 92 of the outer casing part 84, the outer casing part may be telescoped over the inner casing part. As shown in FIGS. 1 and 2, the maximum telescoped positioning is with the projection 100 of the inner casing part 86 having moved forwardly along the longitudinal positioning slot 92 and to the transverse rear backset positioning slot 94 of the outer casing part 84 followed by partial relative rotation between the casing parts engaging the projection 100 transversely fully within the transverse rear backset positioning slot and comprising the casing minimum backset position. Reverse relative rotation followed by longitudinal relative movement and finally followed by again relative rotations will move the projection 100 progressively from the transverse rear backset positioning slot 94 through the longitudinal positioning slot 92 and fully transversely into the transverse forward backset positioning slot 96 placing the outer and inner casing parts 84 and 86 in the relative positions shown in FIG. 8 comprising the casing maximum backset position.

Furthermore, the transverse rear and forward backset positioning slots 94 and 96 connected by the longitudinal positioning slot 92 operating with the projection 100 of these outer and inner casing parts 84 and 86 comprise a bayonet joint connection between these casing parts and for accomplishing such backset position adjustment.

As hereinbefore discussed, the backset dimension of a latch construction is the distance from the transverse axis of the latch operator longitudinally forwardly to the forward extremities of the bolt casing. With the particular deadbolt construction illustrated, this backset dimension would be calculated from the transverse axis of the primary and secondary spindles 46 and 58 longitudinally forwardly to the front or door edge surface of the face plate assembly 88 which, in this case, comprises the forward extremity of the bolt casing. In the present industry, the smaller or minimum backset measurement is two and three eighths inches and the larger or maximum backset measurement is two and three quarters inches.

Thus, with the preferred embodiment of the latch construction of the present invention, the deadbolt construction illustrated, the casing and bolt minimum backset position is shown in FIGS. 1, 2, 3 and 5. The outer casing part 84 is longitudinally telescoped a maximum distance with the inner casing part 86 and the projection 100 of the inner casing part is fully within the transverse rear backset positioning slot 94 of the outer casing part. At the same time, the outer bolt 70 is longitudinally telescoped a maximum with the inner bolt carriage 72, the projections 76 of the outer bolt being fully transversely in the rear backset positioning slots 80 of the inner bolt carriage. The deadbolt construction is, therefore, normally fully operable for extending and retracting the bolt assembly 24 in this casing and bolt minimum backset position. Furthermore, as seen in FIG. 1, a spring friction member 102 is positioned center engaged at the inner casing part 86 and leg engaged with the outer casing part 84 to frictionally resist, while still permitting, the movements between the casing and bolt various parts for frictional retention in this backset setting.

Figure 4:
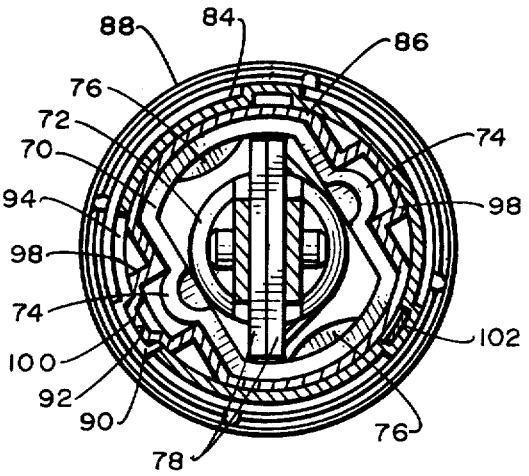
FIG. 4 is a view similar to FIG. 3, but with both the casing and bolt backset adjustments being transversely partially rotated to begin the selective backset adjustment movement.
Figure 6:
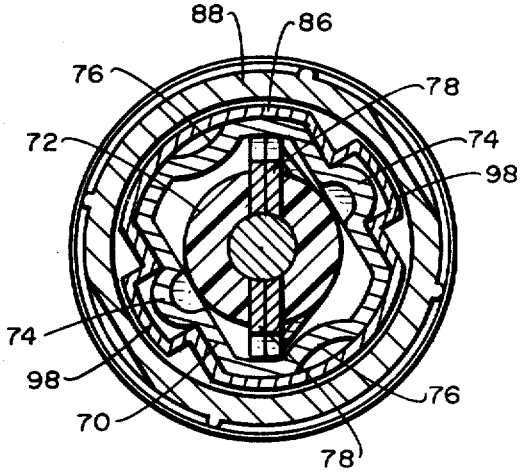
FIG. 6 is a view similar to FIG. 5, but with the bolt backset adjustment transversely partially rotated beginning the backset adjustment movement.

If, however, it is desired to position the deadbolt construction in maximum backset position, the backset adjustment is made prior to mounting the deadbolt construction in the door. First, with the bolt assembly 24 in extended position exposing the outer bolt 70 in extended position, the outer bolt is grasped with one hand and the latch stationary frame 34 with the other hand applying rotative motion therebetween. This semi-rotates both the outer bolt 70 and the inner casing part 86 since the two are rotatably tied together by their common shapes as hereinbefore described and shown in FIG. 9. Furthermore, this moves the projection 100 on the inner casing part 86 transversely along the transverse rear backset positioning slot 94 in the outer casing part 84 from the position of FIG. 3 to the position of FIG. 4 longitudinally aligned with the longitudinal positioning slot 92 of the outer casing part 84. It also moves the outer bolt 70 and the projections 76 thereof transversely out of the rear backset positioning slots 80 of the inner bolt carriage 72 from the position of FIGS. 3 and 5 to the position of FIGS. 4 and 6. During this rotative motion, the outer casing part 84 and the inner bolt carriage 72 remain nonrotatable relative to each other due to the outer casing part securement to the latch stationary frame 34 and the inner bolt carriage pivotal securement to the driving levers 64 of the latch driving mechanism 32.

Figure 7:
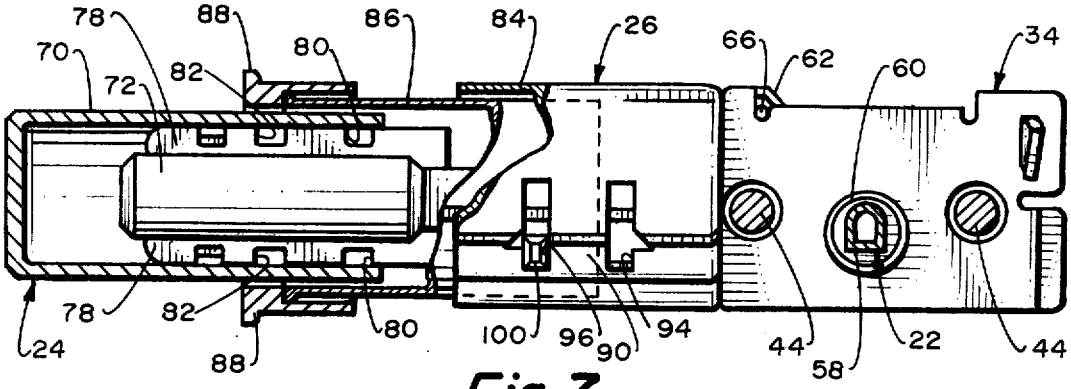
FIG. 7 is a reduced, longitudinal, vertical sectional view similar to FIG. 2, but showing certain parts of both the casing and bolt moved longitudinally forwardly in intermediate backset adjustment movement.
Figure 5:
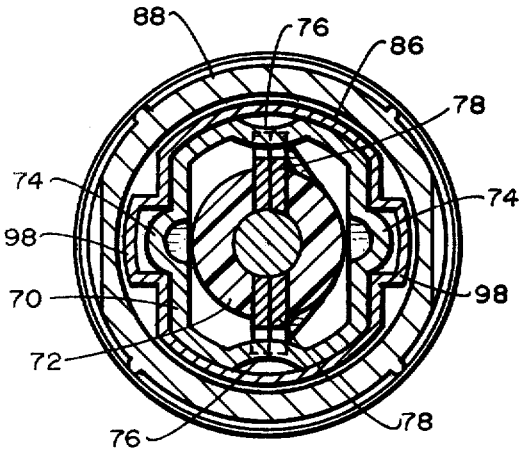
FIG. 5 is an enlarged, transverse, vertical sectional view similar to FIG. 3 prior to backset adjustment commencement, but looking in the direction of the arrows 5—5 in FIG. 2, the section being taken through the bolt backset adjustment.

Thereafter, outward longitudinal force on the outer bolt 70 and the inner casing part 86 while retaining the latch stationary frame 34 to thereby retain the inner bolt carriage 72 and the outer casing part 84 will longitudinally extend both the bolt assembly 24 and the casing assembly 26 to the position shown in FIG. 7. Actually, with the particular embodiment shown, the guide tabs 74 on the outer bolt 70 are in longitudinal abutting relation with the back surface of the face plate assembly 88 when the bolt assembly 24 is extended, as shown in FIG. 1, so that forward movement of the outer bolt 70 automatically carries the inner casing part 86 simultaneously therewith to the position of FIG. 7. The projection 100 of the inner casing part 86 has moved along the longitudinal positioning slot 92 of the outer casing part 84 and the projections 76 of the outer bolt 70 have moved along the cylindrical surfaces of the inner bolt carriage 72. Finally, transverse partial rotation of the outer bolt 70 transversely realigns each of the bolt and casing assemblies 24 and 26 into the positions of FIG. 8 wherein the projections 76 of the outer bolt 70 are transversely engaged in the forward backset positioning slots 82 of the inner bolt carriage 72 and the projection 100 in the transverse forward backset positioning slot 96, this being the bolt maximum backset position.

According to the present invention, therefore, an improved latch bolt construction is provided which permits selective adjustment thereof adapting the same to either of at least two backset adjustments. Merely by the carrying out of a simple manipulation procedure which does not require expert knowledge of the latch construction, simple, preferably bayonet joint connections within the bolt and casing of the latch construction permit the latch construction to be adjusted quickly and efficiently for such backset conversion. According to modern industry standards, and with a modern latch construction, the minimum backset dimension setting will be two and three eighths inches and the maximum backset dimension setting will be two and three quarters inches, all as hereinbefore described. Thus, the prior necessity of multiple latch construction models is eliminated while still providing the necessary backset dimension alterations.

I claim:

1. In a latch construction for mounting in doors and the like of the type having a bolt longitudinally reciprocal in a door-mounted stationary casing between a forward extended position projecting from a door edge and a rearward retracted position substantially fully within the door edge, latch operating means forwardly operably connected to said bolt and rearwardly operably connected to an operator thereof, said operating means operator being movable about a transverse axis actuating said operating means to reciprocate said bolt, the longitudinal distance between forward extremities of said casing and said operator axis constituting backset; the improvements comprising: casing projection and slot means operably connected to said casing selectively longitudinally adjustable a determined amount for increasing or decreasing said backset said determined amount; bolt projection and slot means operably connected to said bolt selectively longitudinally adjustable a same said determined amount for coordinating with said casing backset increasing or decreasing; each of said casing and bolt projection and slot means including a pair of longitudinally spaced transverse slot portions joined by a longitudinal slot portion.

2. In a latch construction as defined in claim 1 in which transverse engagement means is operably connected between said casing and said bolt for requiring common transverse rotation of said casing and bolt.

3. In a latch construction as defined in claim 1 in which said casing is formed of first and second longitudinal parts operably connected by said casing projection and slot means with said parts being selectively longitudinally adjustable by said projection and slot means said determined amount for said increasing or decreasing said backset said determined amount; and in which said bolt is formed of first and second longitudinal parts operably connected by said bolt projection and slot means with said parts being selectively longitudinally adjustable by said projection and slot means said same said determined amount for said coordinating with said casing basket increasing or decreasing.

4. In a latch construction as defined in claim 1 in which said casing is formed of telescoped first and second longitudinal parts operably connected by said casing projection and slot means with said parts being selectively longitudinally adjustable in said telescoping by said projection and slot means said determined amount for said increasing or decreasing said backset said determined amount; and in which said bolt is formed of telescoped first and second longitudinal parts operably connected by said bolt projection and slot means with said parts being selectively longitudinally adjustable in said telescoping by said projection and slot means said same said determined amount for said coordinating with said casing backset increasing or decreasing.

5. In a latch construction as defined in claim 1 in which said casing is formed of first and second longitudinal parts operably connected by said casing projection and slot means with said parts being selectively longitudinally adjustable by said projection and slot means said determined amount for said increasing or decreasing said backset said determined amount; in which said bolt is formed of first and second longitudinal parts operably connected by said bolt projection and slot means with said parts being selectively longtitudinally adjustable by said projection and slot means said same determined amount for said coordinating with said casing backset increasing or decreasing; and in which transverse engagement means is operably connected between said casing and said bolt for requiring common transverse rotation of said casing and bolt.

6. In a latch construction as defined in claim 1 in which said casing is formed of telescoped first and second longitudinal parts operably connected by said casing projection and slot means with said parts being selectively longitudinally adjustable in said telescoping by said projection and slot means said determined amount for said increasing or decreasing said backset said determined amount; in which said bolt is formed of telescoped first and second longitudinal parts operably connected by said bolt projection and slot means with said parts being selectively longitudinally adjustable in said telescoping by said projection and slot means said same said determined amount for said coordinating with said casing backset increasing or decreasing; and in which transverse engagement means is operably connected between said casing and said bolt for requiring common transverse rotation of said casing and bolt.

7. In a latch construction for mounting in doors and the like of the type having a bolt longitudinally reciprocal in a door-mounted stationary casing between a forward extended position projecting from a door edge and a rearward retracted position substantially fully within the door edge, latch operating means forwardly operably connected to said bolt and rearwardly operably connected to an operator thereof, said operating means operator being movable about a transverse axis actuating said operating means to reciprocate said bolt, the longitudinal distance between forward extremities of said casing and said operator axis constituting backset; the improvements comprising: casing adjustment means operably connected to said casing including transverse rotation means selectively operable for longitudinally adjusting said casing to increase or decrease said backset; bolt adjustment means operably connected to said bolt including transverse rotation means selectively operable for longitudinally adjusting said bolt to coordinate with said casing backset; engagement means operably connected between said casing and said bolt for requiring simultaneous operation of said casing and bolt transverse rotation means upon selective operation of either of said casing and bolt transverse rotation means.

8. In a latch construction as defined in claim 7 in which each of said casing and bolt is formed of two parts with one part of each of said casing and bolt including said transverse rotation means and said engagement means operable connection.

9. In a latch construction as defined in claim 7 in which each of said casing and bolt is formed of two telescoped parts with one of said casing and bolt telescoped parts including said transverse rotation means and said engagement means operable connection.

* * * * *